US007129447B1

(12) United States Patent
Kim et al.

(10) Patent No.: US 7,129,447 B1
(45) Date of Patent: Oct. 31, 2006

(54) OVEN

(75) Inventors: Sung Kwang Kim, Ansan-Si (KR); Yu Jeub Ha, Suwon-Si (KR); Kyoung Ho Kim, Suwon-Si (KR); Seok Weon Hong, Yongin-Si (KR); Kil Young Lee, Suwon-Si (KR); Cheol Jin Kim, Suwon-Si (KR); Yun Ic Hwang, Suwon-Si (KR); Sang Hyun Kang, Seoul (KR); Sung Soo Park, Hwaseong-Si (KR); Tae Ho Kim, Hwaseong-Si (KR); Pung Yeun Cho, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/280,197

(22) Filed: Nov. 17, 2005

(30) Foreign Application Priority Data

Jun. 10, 2005 (KR) ..... 10-2005-0049796

(51) Int. Cl.

| | |
|---|---|
| ***A21B 1/22*** | (2006.01) |
| ***F27D 7/04*** | (2006.01) |
| ***F24C 15/16*** | (2006.01) |
| ***F24C 15/32*** | (2006.01) |
| ***F24C 15/34*** | (2006.01) |

(52) U.S. Cl. ..... 219/394; 126/337 R

(58) Field of Classification Search ..... 219/394
See application file for complete search history.

(56) References Cited

U.S. PATENT DOCUMENTS 1,657,205 A * 1/1928 Ehrgott ..... 219/400
5,618,458 A * 4/1997 Thomas ..... 219/394
6,545,251 B1 * 4/2003 Allera et al. ..... 219/394

FOREIGN PATENT DOCUMENTS

| | | | |
|---|---|---|---|
| FR | 2629182 A | * | 9/1989 |
| GB | 2321962 A | * | 12/1998 |
| JP | 63172837 A | * | 7/1988 |
| KR | 2002-2432 | | 1/2002 |

* cited by examiner

*Primary Examiner*—Joseph M. Pelham
(74) *Attorney, Agent, or Firm*—Staas & Halsey LLP

(57) ABSTRACT

An oven having a partition unit to partition a cooking space into a plurality of independent cooking chambers wherein the partition unit has a heat-insulating structure to prevent heat transfer between the respective cooking chambers. The oven comprises a cabinet, a door to open and close an opened front surface of the cabinet, a partition unit to partition the interior of the cabinet into a plurality of independent cooking chambers, and electric heaters mounted in the cooking chambers. The partition unit includes first and second heat-insulating layers opposite to each other and an air layer disposed between the first and second heat-insulating layers. An inlet and an outlet are formed at the air layer, and a blowing fan is mounted at the inlet. Bent guide members are disposed in the air layer to guide air such that the air uniformly flows throughout the air layer.

8 Claims, 4 Drawing Sheets

OVEN

CROSS-REFERENCE TO RELATED APPLICATIONS

This application claims the benefit of Korean Patent Application No. 2005-49796, filed on Jun. 10, 2005 in the Korean Intellectual Property Office, the disclosure of which is incorporated herein by reference.

BACKGROUND OF THE INVENTION

1. Field of the Invention

The present invention relates to an oven. More particularly, to an oven having a partition unit to partition a cooking space into a plurality of independent cooking chambers wherein the partition unit includes a heat-insulating structure to prevent heat transfer between the respective cooking chambers, whereby several kinds of food are cooked at optimum temperatures in the respective cooking chambers.

2. Description of the Related Art

Conventional ovens are classified into a microwave oven to cook food using microwaves, an electric oven to cook food using an electric heater, and a gas oven to cook food using gas heat. Each oven includes a plurality of partitions mounted in a cooking space, which is partitioned into a plurality of independent cooking chambers by the partitions, whereby several kinds of food is simultaneously cooked, and therefore, cooking time is reduced.

An example of ovens each having a plurality of cooking chambers partitioned by a plurality of partitions is disclosed in Korean Unexamined Patent Publication No. 2002-0002432.

The above-mentioned conventional oven includes upper, middle, and lower shelves, by which a cooling space of the oven is vertically partitioned into a plurality of cooking chambers, and magnetron assemblies and electric heaters mounted at the side surfaces and the upper part of the cooling chambers, respectively, whereby several kinds of food are simultaneously cooked.

In the conventional oven with the above-stated construction, however, each of the shelves to partition the cooking chambers does not include a heat-insulating structure. As a result, heat transfer is performed between the respective cooking chambers. Consequently, it is difficult to maintain the respective cooking chambers at optimum temperatures, and therefore, it is difficult to cook food under optimum cooking conditions.

When food to be cooked at a relatively high temperature and food to be cooked at a relatively low temperature are simultaneously cooked, for example, heat is transferred from the cooking chamber where the food is cooked at the high temperature to the cooking chamber where the food is cooked at the low temperature via the corresponding shelf. As a result, the temperature of the cooking chamber where the food is cooked at the low temperature is increased. Consequently, the food is not cooked at the optimum temperature.

Furthermore, when food is cooked in one of the cooking chambers, heat is transferred to the other cooking chambers where food is not being cooked via shelves. Consequently, energy is wasted.

SUMMARY OF THE INVENTION

Accordingly, it is an aspect of the invention to provide an oven having a partition unit to partition a cooking space into a plurality of independent cooking chambers wherein the partition unit includes a heat-insulating structure to prevent heat transfer between the respective cooking chambers.

Additional aspects and/or advantages of the invention will be set forth in part in the description which follows and, in part, will be apparent from the description, or may be learned by practice of the invention.

The foregoing and/or other aspects of the present invention are achieved by providing an oven including at least one partition unit to partition a cooking space into a plurality of independent cooking chambers, wherein the at least one partition unit includes an air layer defined therein.

The at least one partition unit further includes first and second heat-insulating layers opposite to each other about the air layer.

The at least one partition unit further includes an inlet and an outlet formed at the air layer while being spaced a predetermined distance from each other, whereby air is circulated in the air layer through the inlet and the outlet.

The at least one partition unit further includes a blowing fan mounted at the inlet, whereby air is forcibly circulated in the air layer.

The at least one partition unit further includes at least one guide member disposed in the air layer to guide air introduced into the air layer through the inlet such that the air uniformly flows throughout the air layer.

The at least one guide member is bent from the inlet toward the outlet.

It is another aspect of the present invention to provide an oven including a cabinet having an opened front surface, a door to open and close the opened front surface of the cabinet, at least one partition unit to vertically partition the interior of the cabinet into a plurality of independent cooking chambers, and electric heaters mounted in the respective cooking chambers to heat food, wherein the at least one partition unit includes first and second heat-insulating layers opposite to each other, and an air layer disposed between the first and second heat-insulating layers, thereby preventing heat transfer between the cooking chambers.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
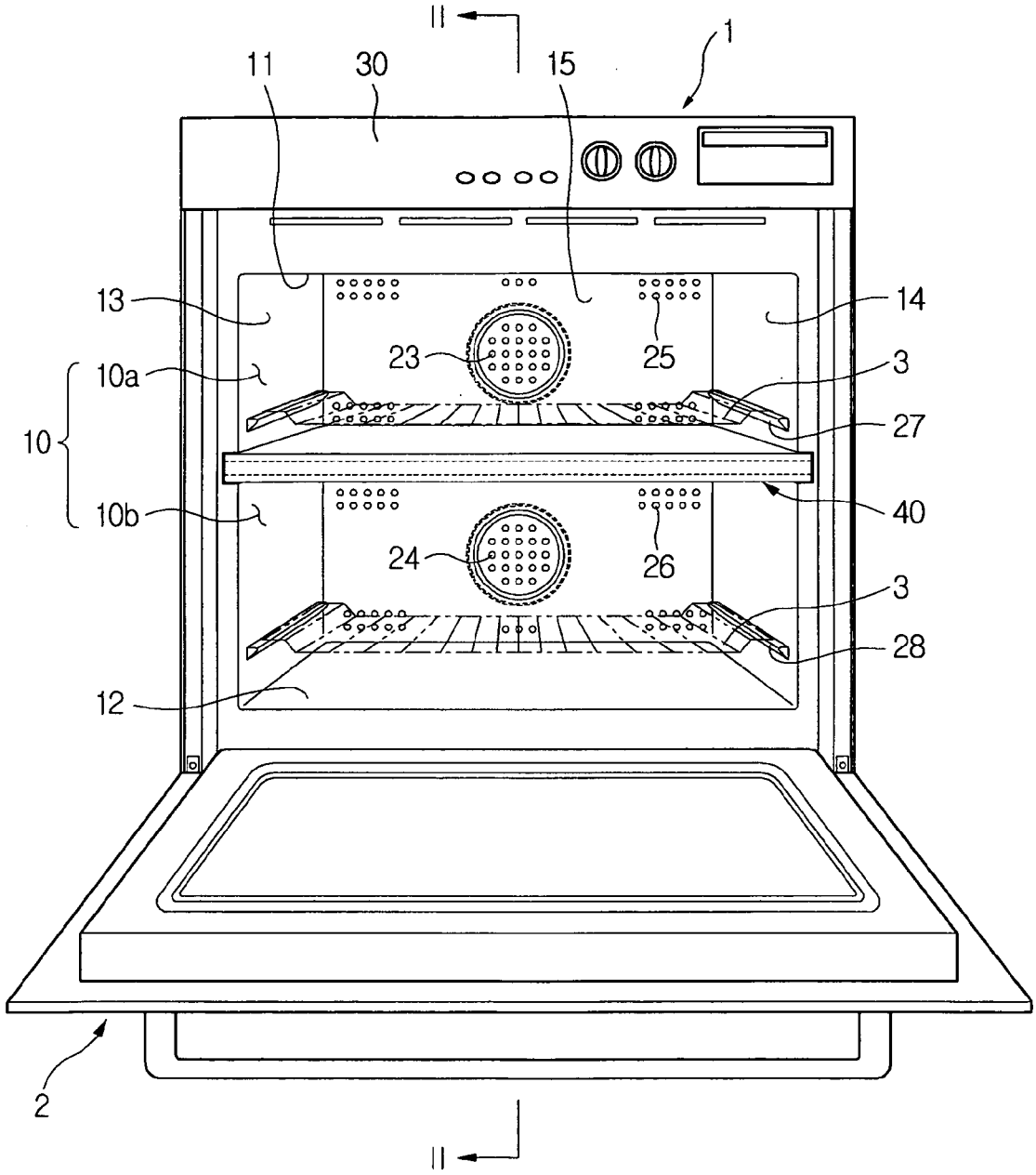
FIG. 1 is a front view schematically illustrating an oven according to the present invention.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 2:
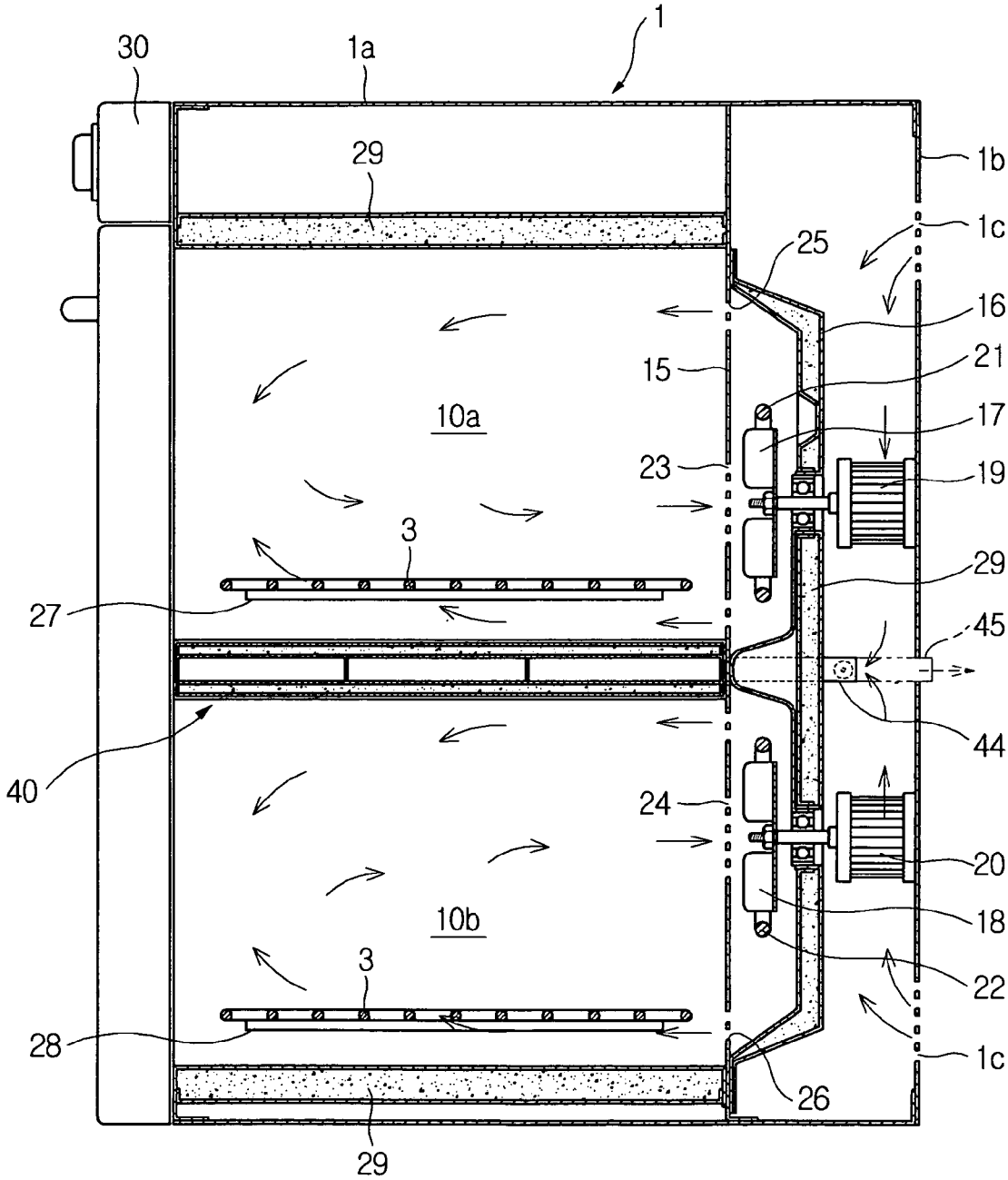
FIG. 2 is a sectional view taken along line II—II of FIG. 1.

FIG. 1 is a front view schematically illustrating the structure of an oven according to the present invention, and FIG. 2 is a sectional view taken along line II—II of FIG. 1.

As shown in FIGS. 1 and 2, the oven comprises a cabinet 1, formed of a box-shape having an opened front surface, the cabinet comprising a cooking space 10 defined therein, and a door 2 hingedly connected with a lower end of the cabinet 2 to open and close the opened front surface of the cabinet 1. The cabinet 1 and the door 2 form the outer appearance of the oven.

The cooking space 10 is defined by a top plate 11, a bottom plate 12, two side plates 13 and 14, and a rear plate 15. The top plate 11 and the rear plate 15 are spaced predetermined distances from a top plate 1*a* and a rear plate 1*b* of the cabinet 1, respectively.

The cooking space 10 is partitioned into a first cooking chamber 10*a* and a second cooking chamber 10*b* by a partition unit 40 disposed in the cooking space 10 to vertically partition the cooking space 10 such that different kinds of food are simultaneously cooked in the first cooking chamber 10*a* and the second cooking chamber 10*b*. As an alternative, a plurality of partition units 40 may be disposed in the cooking space 10 to partition the cooking space 10 into a larger number of independent cooking chambers.

The partition unit 40 is connected with the side plates 13 and 14 and the rear plate 15. The partition unit 40 comprises a heat-insulating structure to prevent heat transfer between the first cooking chamber 10*a* and the second cooking chamber 10*b*. The heat-insulating structure of the partition unit 40 will be described below with reference to FIGS. 3 and 4.

A fan cover 16 is attached with an outside of the rear plate 15. First and second convection fans 17 and 18 are mounted between the rear plate 15 and the fan cover 16 to circulate air through the first cooking chamber 10*a* and air through the second cooking chamber 10*b*, respectively.

At the outer circumferences of the first and second convection fans 17 and 18 are mounted first and second electric heaters 21 and 22, respectively. First and second drive motors 19 and 20 are disposed between the fan cover 16 and the rear plate 1*b* of the cabinet 1, the first drive motor 19 is connected with the first convection fan 17, and a second drive motor 20 is connected with the second convection fan 18.

At the upper and lower parts of the rear plate 15, which are opposite to the first and second convection fans 17 and 18, respectively, are formed a plurality of first and second suction holes 23 and 24, respectively. At the edge of the rear plate 15 are formed a plurality of first and second discharge holes 25 and 26.

At the side plates 13 and 14 corresponding to the lower parts of the first and second cooking chambers 10*a* and 10*b* are provided first and second rails 27 and 28, respectively. To the first and second rails 27 and 28 are detachably attached racks 3 such that the racks 3 are supported by the first and second rails 27 and 28. Food to be cooked is placed on the racks 3 in the first and second cooking chambers 10*a* and 10*b*.

To the outsides of the top plate 11, the bottom plate 12, the side plates 13 and 14, by which the cooking space 10 is defined, and the fan cover 16 are attached heat-insulating members 29 to thermally insulate the cooking space 10. At the upper end of the cabinet 1 is mounted a control panel 30 to control a cooking process.

When a user puts food onto the respective racks 3 supported by the first and second rails 27 and 28, closes the door 2, and manipulates the control panel 30, the first and second electric heaters 21 and 22 generate heat, and the first and second convection fans 17 and 18 are operated by the first and second drive motors 19 and 20, respectively. As a result, air is suctioned to a space between the rear plate 15 and the fan cover 16 from the first and second cooking chambers 10*a* and 10*b* through the first and second suction holes 23 and 24, respectively, heated by the first and second electric heaters 21 and 22, and then discharged into the first and second cooking chambers 10*a* and 10*b* through the first and second discharge holes 15 and 26, respectively. In this way, the air is circulated to cook the food on the racks 3.

When different kinds of food are simultaneously cooked in the first and second cooking chambers 10 and 10*b*, the first and second cooking chambers 10*a* and 10*b*, which are maintained at different high temperatures, are thermally insulated by the partition unit 40. As a result, heat exchange is not performed between the first and second cooking chambers 10*a* and 10*b*, and therefore, the different kinds of food are simultaneously cooked at different optimum cooking temperatures.

When food is cooked in the first cooking chamber 10*a* or the second cooking chamber 10*b*, heat is not transferred from one cooking chamber, where the food is cooked, to the other cooking chamber, where the food is not cooked, by the partition unit 40. Consequently, heat loss is not suffered.

Now, the structure and operation of the partition unit 40, by which the present invention is characterized, will be described with reference to FIGS. 3 and 4.

Figure 3:
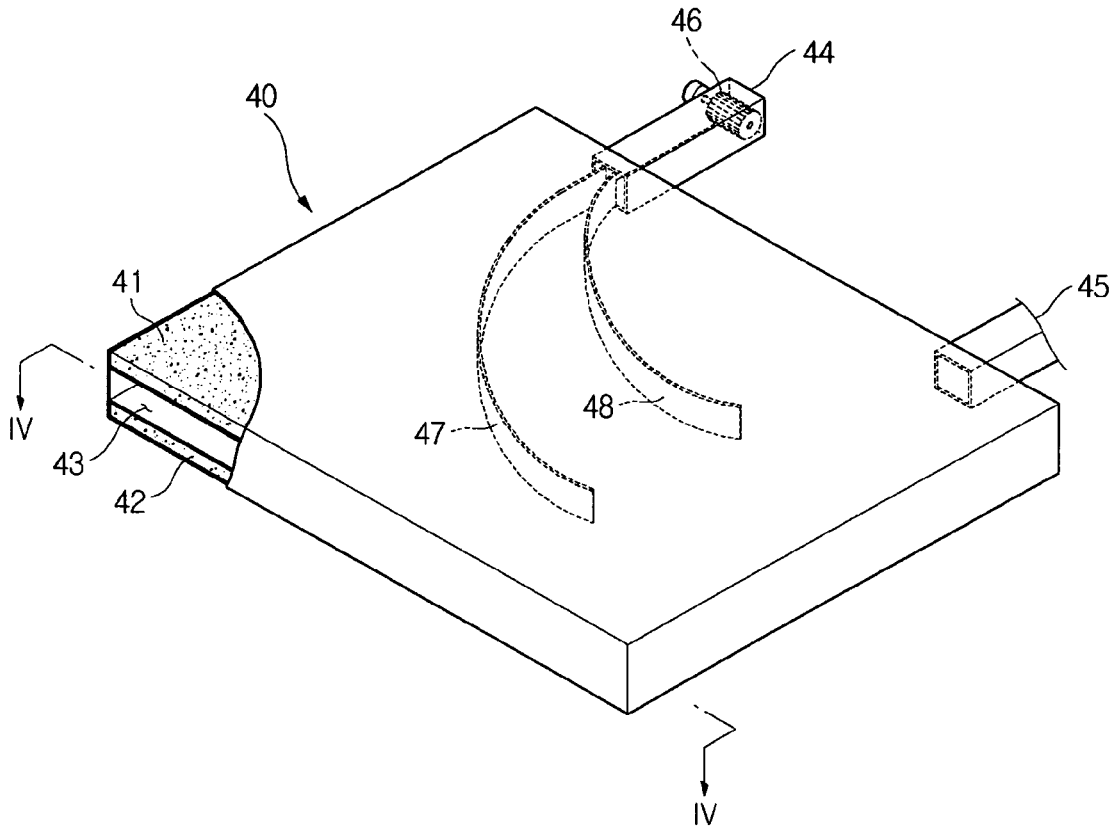
FIG. 3 is a perspective view illustrating the partition unit shown in FIG. 2.
Figure 4:
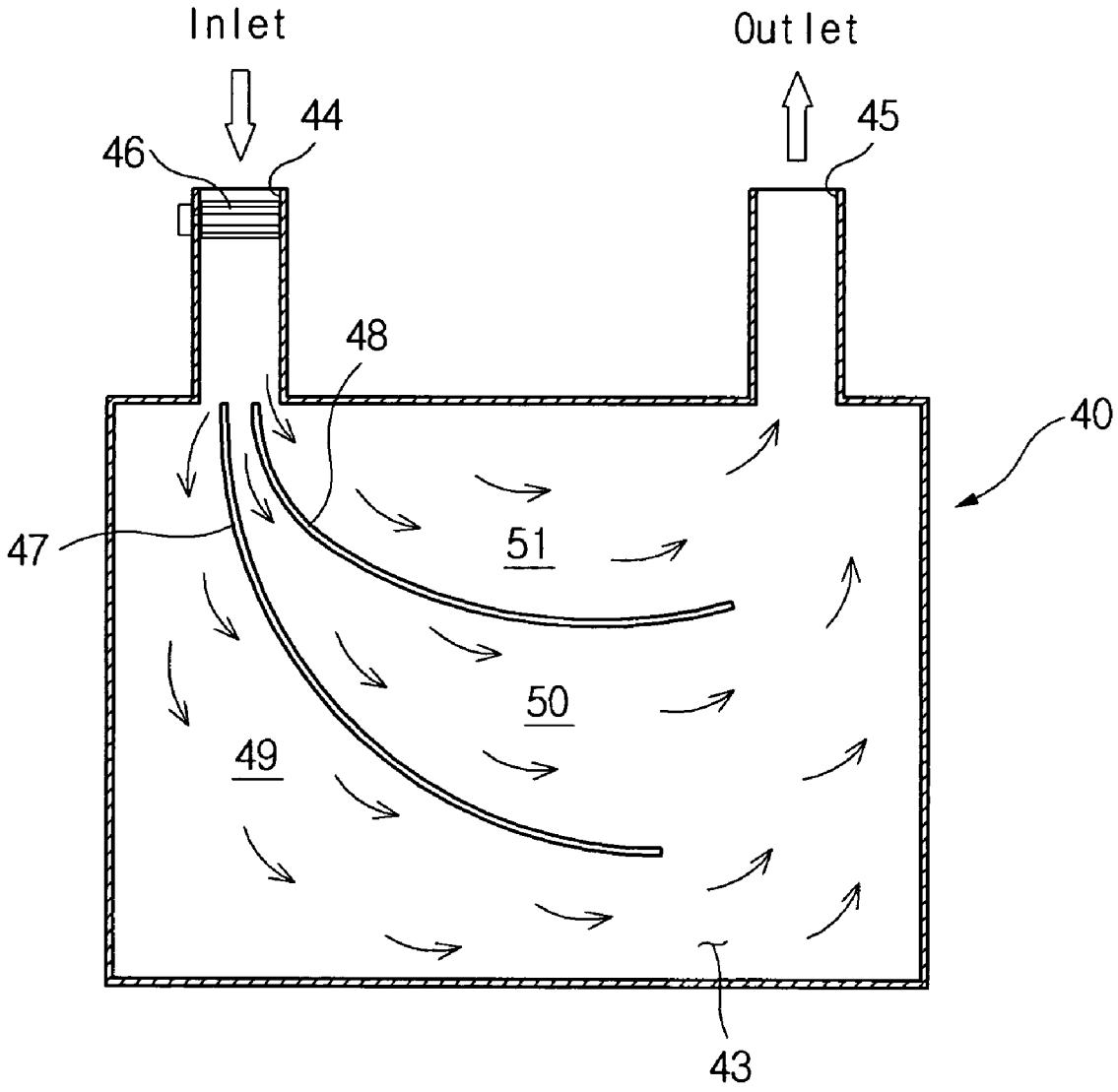
FIG. 4 is a sectional view taken along line IV—IV of FIG. 3.

FIG. 3 is a perspective view illustrating the partition unit shown in FIG. 2, and FIG. 4 is a sectional view taken along line IV—IV of FIG. 3.

As shown in FIGS. 3 and 4, the partition unit 40 comprises a first heat-insulating layer 41, which forms the bottom surface of the first cooking chamber 10*a* disposed at the upper part of the cooking space 10, a second heat-insulating layer 42, which forms the top surface of the second cooking chamber 10*b* disposed at the lower part of the cooking space 10, and an air layer, having a uniform height, disposed between the first heat-insulating layer 41 and the second heat-insulating layer 42.

Alternatively, the partition unit 40 may have only the air layer 43 to effectively prevent heat transfer between the first and second cooking chambers 10*a* and 10*b*, since the air includes a very low heat transfer property.

The first and second heat-insulating layers 41 and 42 each comprise a material having excellent heat resistance and heat insulation properties. Consequently, heat transfer between the first and second cooking chambers 10*a* and 10*b* is maximally prevented by the first and second heat-insulating layers 41 and 42. Furthermore, the air layer 43, which is filled with air having a very low heat transfer property, is disposed between the first and second heat-insulating layers 41 and 42. Consequently, heat transfer between the first and second cooking chambers 10*a* and 10*b* is further effectively prevented by the air layer 43.

Air is circulated through the air layer 43 to improve heat-insulating efficiency of the partition unit 40. To this end, an inlet 44 and an outlet 45 are formed at both side parts of the air layer 43, and a blowing fan 46 is mounted at the inlet 44.

Also, first and second guide members 47 and 48 are disposed in the air layer 43. Consequently, air introduced into the air layer 43 through the inlet 44 by the blowing fan 46 uniformly flows throughout the air layer 43 while being guided by the first and second guide members 47 and 48, and is then discharged out of the air layer 43 through the outlet 45.

The first and second guide members 47 and 48 are bent from the inlet 44 to positions adjacent to the outlet 45, and a plurality of air flow channels 49, 50, and 51 is formed in the air layer 43 by the first and second guide members 47 and 48. Consequently, air introduced into the air layer 43 through the inlet 44 flows to the outlet 45 through the air flow channels 49, 50, and 51 without flow resistance.

As the blowing fan 46 is operated, outside air is introduced into the air layer 43 through the inlet 44, flows though the air flow channels 49, 50, and 51 in the air layer 43 while being guided by the first and second guide members 47 and 48, and is then discharged out of the cabinet 1 through the outlet 45.

At the rear plate 1*b* of the cabinet 1 is formed a plurality of through-holes 1*c*, through which outside air is guided to the inlet 44, and the outlet 45 extends outward through the rear plate 1*b* of the cabinet 1 (see FIG. 2).

Heat transfer between the first and second cooking chambers 10*a* and 10*b* is prevented by the partition unit 40 with the above-stated construction. Consequently, different kinds of food are simultaneously cooked in the first and second cooking chambers 10*a* and 10*b* at optimum cooking conditions. Especially, different kinds of food are effectively cooked without being affected by each other although the difference in optimum cooking temperatures is great.

As apparent from the above description, the present invention provides an oven having a partition unit to partition a cooking space into a plurality of cooking chambers wherein the partition unit comprises a heat-insulating structure to prevent heat transfer between the respective cooking chambers. Consequently, the present invention provides the advantage of quickly and effectively cooking different kinds of food having different optimum cooking temperatures while maximally preventing heat loss.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An oven comprising:

at least one partition unit to partition a cooking space into a plurality of independent cooking chambers, wherein the at least one partition unit comprises an air layer defined therein and first and second heat-insulating layers opposite to each other about the air layer.

2. An oven comprising:

at least one partition unit to partition a cooking space into a plurality of independent cooking chambers, wherein the at least one partition unit comprises an air layer defined therein and an inlet and an outlet formed at the air layer while being spaced a predetermined distance from each other, whereby air is circulated in the air layer through the inlet and the outlet.

3. The oven according to claim 2, wherein the at least one partition unit further comprises a blowing fan mounted at the inlet, whereby air is forcibly circulated in the air layer.

4. The oven according to claim 3, wherein the at least one partition unit further comprises at least one guide member disposed in the air layer to guide air introduced into the air layer through the inlet such that the air uniformly flows throughout the air layer.

5. The oven according to claim 4, wherein the at least one guide member is bent from the inlet toward the outlet.

6. An oven comprising:

a cabinet having an opened front surface;

a door to open and close the opened front surface of the cabinet;

at least one partition unit to vertically partition the interior of the cabinet into a plurality of independent cooking chambers; and electric heaters mounted in the respective cooking chambers to heat food, wherein the at least one partition unit comprises first and second heat-insulating layers opposite to each other, and an air layer disposed between the first and second heat-insulating layers, thereby preventing heat transfer between the cooking chambers.

7. The oven according to claim 6, wherein the at least one partition unit further comprises an inlet and an outlet formed at the air layer while being spaced a predetermined distance from each other, and a blowing fan mounted at the inlet, whereby air is forcibly circulated in the air layer.

8. The oven according to claim 6, wherein the at least one partition unit further comprises a plurality of guide members disposed in the air layer to guide air introduced into the air layer through the inlet such that the air uniformly flows throughout the air layer, the guide members being bent from the inlet toward the outlet.

* * * * *